US006712631B1

(12) United States Patent
Youtsey

(10) Patent No.: US 6,712,631 B1
(45) Date of Patent: Mar. 30, 2004

(54) INTERNALLY LOCKING COAXIAL CONNECTOR

(76) Inventor: Timothy L. Youtsey, 1715 W. Sunrise Blvd., Gilbert, AZ (US) 85233

( * ) Notice: Subject to any disclaimer, the term of this patent is extended or adjusted under 35 U.S.C. 154(b) by 0 days.

(21) Appl. No.: 10/309,216

(22) Filed: Dec. 4, 2002

(51) Int. Cl.[7] ..... H01R 13/62
(52) U.S. Cl. ..... 439/322; 439/581
(58) Field of Search ..... 439/312, 313, 439/321, 320, 322, 319, 581; 285/33, 900, 921

(56) References Cited

U.S. PATENT DOCUMENTS

| | | | | | |
|---|---|---|---|---|---|
| 3,390,374 | A | | 6/1968 | Forney, Jr. | |
| 3,601,776 | A | * | 8/1971 | Curl | 439/675 |
| 3,671,922 | A | * | 6/1972 | Zerlin et al. | 439/352 |
| 3,778,535 | A | | 12/1973 | Forney, Jr. | 174/74 C |
| 4,307,926 | A | * | 12/1981 | Smith | 439/610 |
| RE31,995 | E | * | 10/1985 | Ball | 439/488 |
| 4,915,651 | A | | 4/1990 | Bout | 439/578 |
| 5,141,448 | A | * | 8/1992 | Mattingly et al. | 439/314 |
| 5,195,905 | A | | 3/1993 | Pesci | 439/352 |
| 5,205,547 | A | * | 4/1993 | Mattingly | 267/158 |
| 5,548,088 | A | | 8/1996 | Gray et al. | 174/74 R |
| 5,564,938 | A | | 10/1996 | Shenkal et al. | 439/301 |
| 5,595,499 | A | | 1/1997 | Zander et al. | 439/352 |
| 5,607,325 | A | | 3/1997 | Toma | 439/578 |
| 5,651,698 | A | | 7/1997 | Locati et al. | 439/578 |
| 5,938,465 | A | | 8/1999 | Fox, Sr. | 439/350 |
| 6,010,349 | A | | 1/2000 | Porter, Jr. | 439/320 |
| 6,468,100 | B1 | * | 10/2002 | Meyer et al. | 439/320 |

* cited by examiner

*Primary Examiner*—Tulsidas Patel
(74) *Attorney, Agent, or Firm*—Richard C. Litman

(57) ABSTRACT

The internally locking coaxial connector has a conductive insert disposed in an outer body. The insert has a front flange and a lock washer placed between the front flange and an inwardly extending annular flange at the rear of a coupling nut slidable on the outer body. When a male connector is mated with the female connector, the lock washer applies a continuous tension between the male and female connectors to prevent their separation when exposed to vibration or thermal cycling.

5 Claims, 4 Drawing Sheets

INTERNALLY LOCKING COAXIAL CONNECTOR

BACKGROUND OF THE INVENTION

1. Field of the Invention

The present invention relates to coaxial connectors. In particular, the internally locking coaxial connector is a female coaxial connector with a lock washer placed inside the coupling nut that produces a constant tension against a mated male coaxial connector to prevent its loosening or separation during use, especially during periods of vibration and thermal cycling.

2. Description of the Related Art

The present invention is directed to a coaxial cable connector in which the female connector is modified to include a lock washer that applies a constant tension against a mated male connector to reduce or prevent the resulting connection from loosening during use, especially in situations of excessive vibration and thermal cycling.

Coaxial cables come in a variety of sizes and styles, including various configurations of central signal-carrying conductors and shielding. The cables are exposed to environmental factors during their use, whether used indoors or outdoors. Connectors are used to connect cables to respective terminals on electrical equipment and related housings, as well as to other cables. The cables contain a center conductor that carries an electrical signal, e.g. a radio frequency (RF) signal. Signal frequencies typically range from just under 1 MHz to the gigahertz region. A cylindrical dielectric layer surrounds the signal-carrying center conductor, and a cylindrical conductive shielding layer surrounds the dielectric. Finally, a jacket surrounds the shielding layer to complete the cable.

No matter what the frequency of the RF signal, it is important that the shielding layer, and the signal-carrying center conductor when the connector has a center pin, maintain good contact with the connector, and that the connection between a male and a female coaxial cable connector securely maintains continuity between the respective shields of the coaxial cables and between the center conductors of the respective cables in order to avoid insertion loss and to establish a consistently strong signal during use. However, during use, various factors can cause the connectors to loosen, thereby separating the connectors from each other and resulting in loss of signal.

The present invention reduces or eliminates the loss of signal by preventing threaded male and female coaxial cable connectors from separating during use. This is accomplished by incorporating a lock washer inside the female connector that produces a constant tension against a mated male connector.

U.S. Pat. No. 3,390,374, issued to Forney, Jr. on Jun. 25, 1968, teaches a coaxial connector including a locking member using an annular rib or radially inwardly directed barbs to hold a connector onto the prepared end of a cable. U.S. Pat. No. 3,778,535, issued to Forney, Jr. on Dec. 11, 1973, teaches a coaxial connector in which the outer conductor of a cable is squeezed during application of a connector.

U.S. Pat. No. 4,915,651, issued to Bout on Apr. 10, 1990, teaches a coaxial cable connector using two springs to apply axial tension to compensate for axial tolerances when the connector is applied. U.S. Pat. No. 5,195,905, issued to Pesci on Mar. 23, 1993, teaches a coaxial connector including an outer locking ring. U.S. Pat. No. 5,548,088 issued to Gray et al. on Aug. 20, 1996, teaches a coaxial connector in which a radial force is applied on a contacting member to provide on-going pressure engagement between the contacting members without the need for continuance of axial pressure to maintain electrical continuity.

U.S. Pat. No. 5,564,938, issued to Shenkal et al. on Oct. 15, 1996, teaches a coaxial cable connector having an outer sleeve member used to prevent unauthorized cable removal. U.S. Pat. No. 5,595,499, issued to Zander et al. on Jan. 21, 1997, teaches a coaxial connector having improved locking capabilities using radially movable locking arms.

U.S. Pat. No. 5,607,325, issued to Toma on Mar. 4, 1997, teaches a coaxial cable connector including a locking member using radially extending ribs that provide a frictional lock. U.S. Pat. No. 5,651,498, issued to Locati et al. on Jul. 29, 1997, teaches a coaxial cable connector including a ferrule having serrations for mechanically connecting with parts of a cable, a mandrel and a closing collar. U.S. Pat. No. 5,938,465, issued to Fox, Sr. on Aug. 17, 1999, teaches a quick connect-disconnect cable connector.

U.S. Pat. No. 6,010,349, issued to Porter, Jr. on Jan. 4, 2000, teaches a multi-piece connector having pieces that are torqued in two directions to lock the connector onto the cable.

Although various connectors are available for use on coaxial cables, there is a need for a coaxial cable connector that resists or prevents loosening between the male and female connector members during use. Such loosening might occur as a result of thermal cycling, vibration or routine use. The internally locking coaxial connector of the present invention fulfills this need by providing a lock washer member that is inserted in the female connector member with a conductive inner body, so that when the male connector member is threaded into the female member, the lock washer is compressed. The lock washer then produces a continuous tension against the male member that holds the male member at its threads firmly in place against the corresponding threads of the female member, thereby preventing its movement during use.

None of the above inventions and patents, taken either singly or in combination, is seen to describe the instant invention as claimed. Thus an internally-locking coaxial connector solving the aforementioned problems is desired.

SUMMARY OF THE INVENTION

The present invention is directed to a threaded connector for use in a coaxial cable. In particular, the inventive connector is a female connector including a conductive flanged insert and a lock washer member placed next to the flange so that when a corresponding male connector member is threaded into the female member, the contacting face of the male connector bears against the flanged insert and presses against the lock washer member, compressing the lock washer, thereby resulting in a constant tension being applied by the lock washer against the male member that prevents its movement during vibration or thermal cycling.

Accordingly, it is a principal object of the invention tot provide a threaded coaxial cable connector having a female connector portion including a flanged insert and a lock washer positioned between the flange of the insert and an internal flange of the female member.

It is another object of the invention to provide a coaxial cable connector wherein after threaded mating of a corresponding male member into the female member, a lock washer member applies a constant tension against the male member to limit or prevent its movement during thermal cycling or vibration.

It is an object of the invention to provide improved elements and arrangements thereof for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

The present invention is directed to a coaxial cable connector in which the female portion of the connector includes a flanged conductive insert and a lock washer member that rests between the flange of the insert and a flange inside the female connector.

Figure 1:
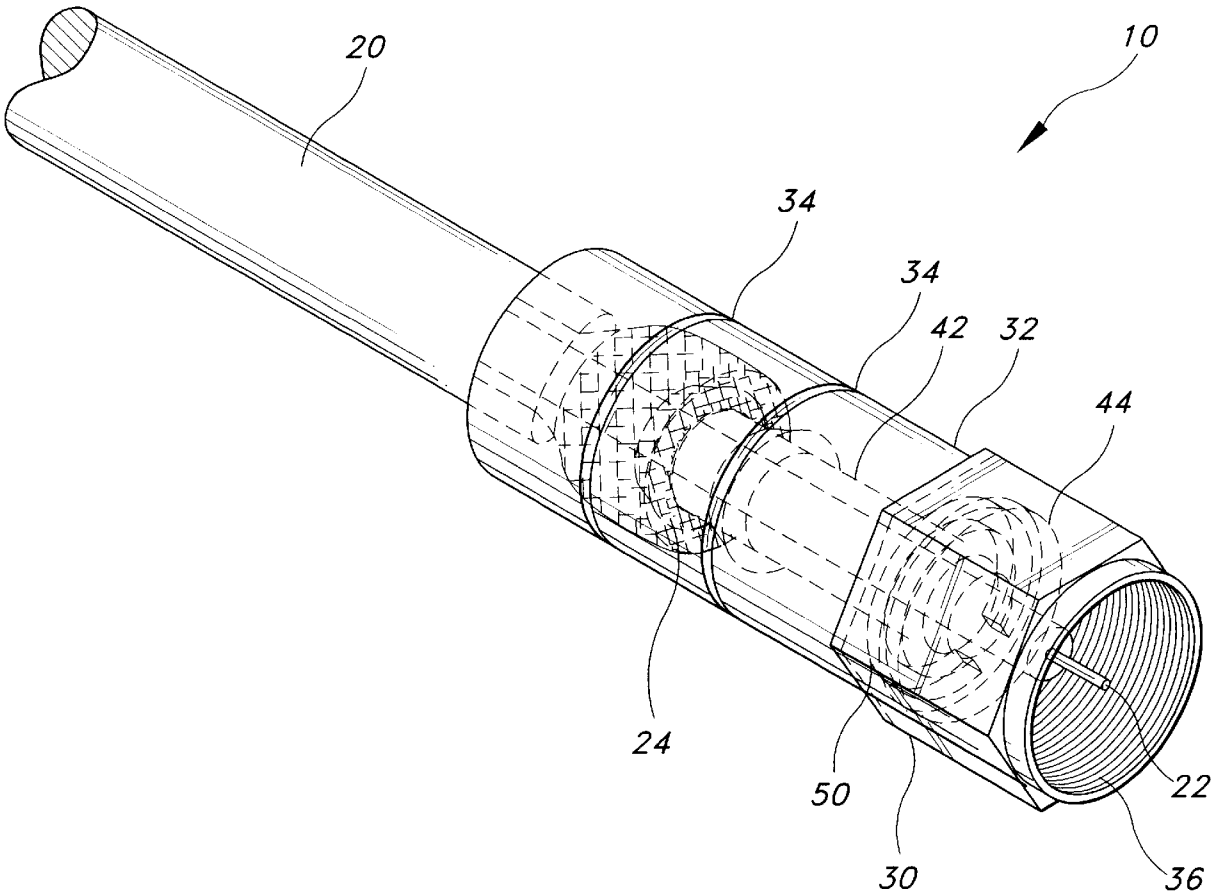
FIG. 1 is an environmental, perspective view of an internally-locking female coaxial connector according to the, present invention.

FIG. 1 shows a perspective view of a threaded female coaxial cable connector 10 fastened to an end of a coaxial cable 20. Coaxial cable 20 as shown includes a signal-carrying center conductor 22 extending longitudinally through the cable 20. The center conductor 22 is surrounded by a conductive shielding layer 24 that is separated from the center conductor 22 by a dielectric layer, as is known in the art. The shielding layer 24 must be conductive and can be present in any of various configurations and conductive materials, as is well known in the field of coaxial cables. For example, the shielding 24 can be braided copper or aluminum wire (often used with very high frequency or alternating current signals) or aluminum foil (used with direct current signals). The shielding 24 can also be present as two or more layers of braided wire or foil or both, depending upon the type of coaxial cable.

Figure 2:
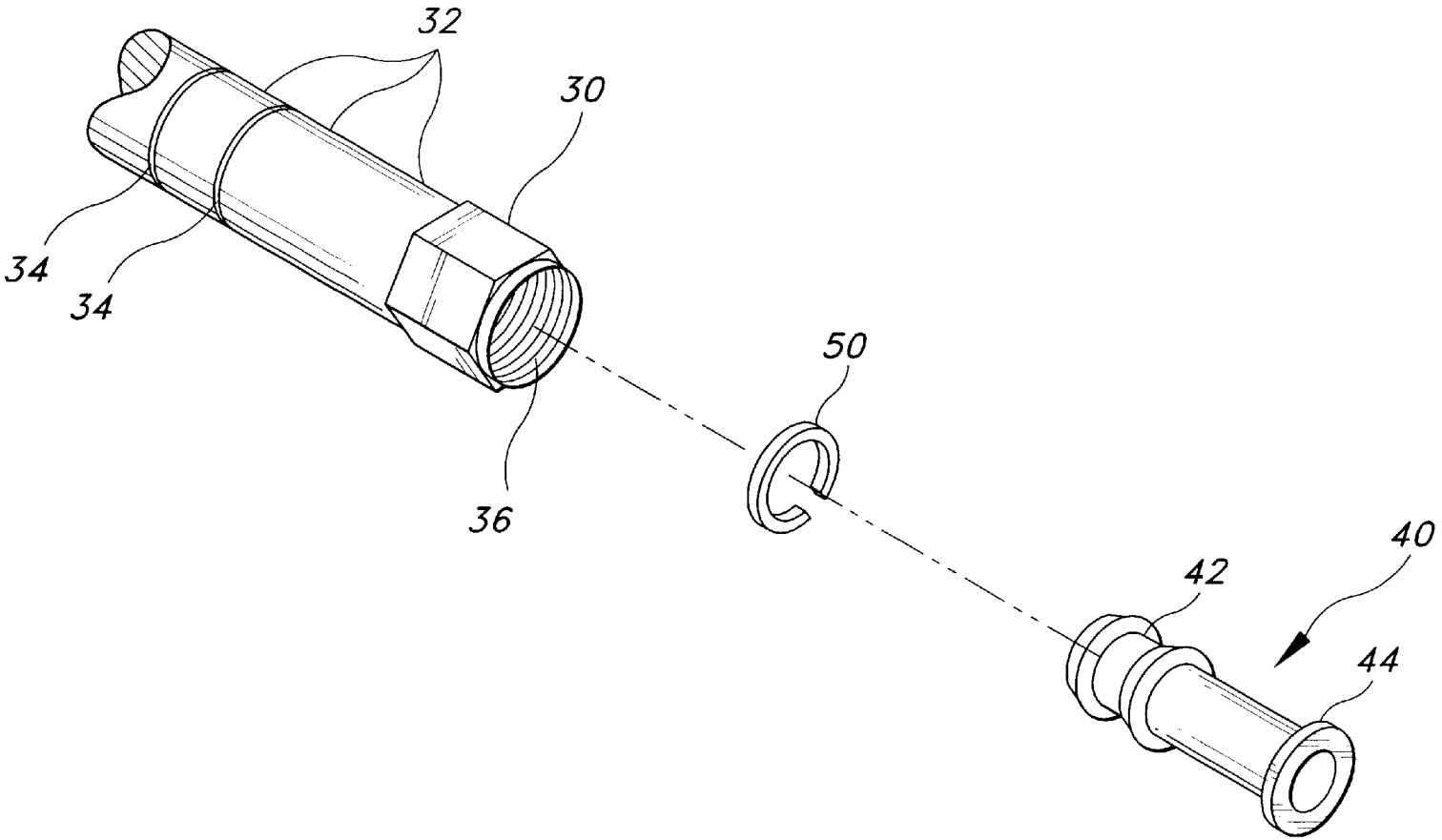
FIG. 2 is an exploded view of the coaxial connector showing the lock washer and conductive insert.

FIG. 2 shows an exploded view of the female connector 10 including a flanged conductive insert 40 and lock washer 50. As shown in FIGS. 1 and 2, lock washer 50 is placed behind the front flange 44 of the conductive insert 40 and in front of an inwardly extending annular flange at the rear of the hex nut coupling 30 of the female connector 10.

In order to fasten the female connector to the end of a cable, the cable end is prepared in a conventional manner, i.e., a portion of the outer jacket of the cable is removed (usually about 1 inch) to expose the shielding. Then the exposed shielding 24 is turned back onto the outer jacket to expose the underlying dielectric. Part of the dielectric is then removed to expose the center conductor 22. The cable end is thus prepared for the connector to be attached to it.

In order to securely fasten the female connector 10 to the prepared cable end, the exposed center conductor 22 is fed through the outer body 32 of the connector 10 until it extends into the hex nut coupling 30. The lock washer 50 is placed into the hex nut coupling 30 until it rests against the rear annular flange (not shown) of the hex coupling 30. Then the end of the cable 20 is passed through the conductive insert 40 in the direction shown in FIGS. 1 and 2, and the shielding 24 is turned in the opposite direction to grip onto the rear end of the body 42 of insert 40. In the case of the insert 40 shown in the figures, the shielding 24 is braided and the body of the insert 40 is provided with ribs providing additional gripping surface area for attaching the shielding. The surface of body 42 can be provided with any suitable features that provide adequate grip for the shielding 24.

After the shielding 24 has been attached to the insert body 42, the cable 20 is pulled to retract the insert 40 into the female connector 20-until the flange 44 sandwiches the lock washer 50 against the rear annular flange of the hex nut coupling 30. The insert 40 may be a press fit into the outer body 32, or at this point the body 32 of the female connector may be crimped in a manner known in the art to permanently secure the connector 10 to the end of the cable 20. This crimping action also results in pressing the shielding 24 into direct and secure contact with the conductive insert 40, thereby ensuring continuity of the shielding 24 through the insert 40. Although the particular type of female connector 10 shown is crimped axially to bring together the grooves 34 in the outer body 32 of the female connector 10, the invention contemplates any known type of crimped connector, including conventional radially crimped connectors (using "hex crimpers"). The resulting connector 10 can now be used to mate with a corresponding male connector.

The female connector includes internal threads 36 inside the hex nut coupling 30 into which a corresponding male connector is threaded.

Figure 3:
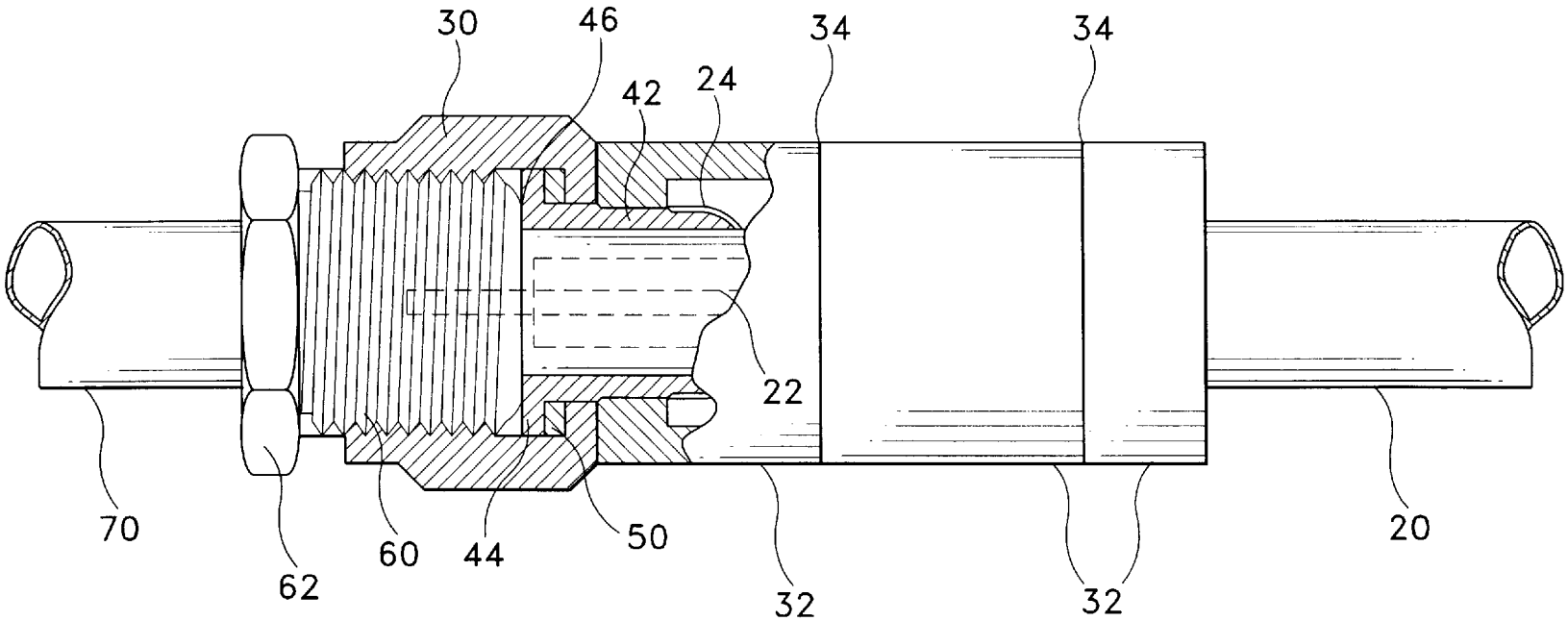
FIG. 3 is a cross-sectional cutaway view of the modified female connector mated with a male connector.

A mated connector is shown in FIG. 3. The female connector 10 is attached to the end of cable 20, while the male connector is attached to the end of cable 70. The male connector includes a male fitting 62 so that the threads 60 of the male connector engage the hex nut coupling 30 of female connector 10. The male connector includes a provision, such as a socket or receptacle (not shown), that ensures electrical continuity of the signal-carrying center conductor 22 of the "female" end of the cable 20 with the corresponding center conductor of the "male" end of the cable 70.

When the male connector is firmly seated inside the female connector 10, as shown in FIG. 3, the conductive face of the male connector rests firmly against the flange 44 of the conductive insert 40 at the contact face 46, thereby establishing continuity between the shielding 24 of the "male" and "female" cable ends. The face of the male connector thus causes the lock washer 50 to become compressed between the flange 44 of the insert and the inwardly extending rear annular flange of the hex nut coupling 30. When fully mated in this manner, the lock washer 50 produces a continuous tension pressing against the male connector. The presence of the threads on the male and female connectors prevents the tension of the lock washer 50 from separating the connectors. Also, during various environmental exposures, including vibration and thermal cycling, the continuous tension applied by the lock washer 50 prevents the male connector from loosening, thereby ensuring electrical continuity between the cables 20 and 70 during use.

Figure 4:
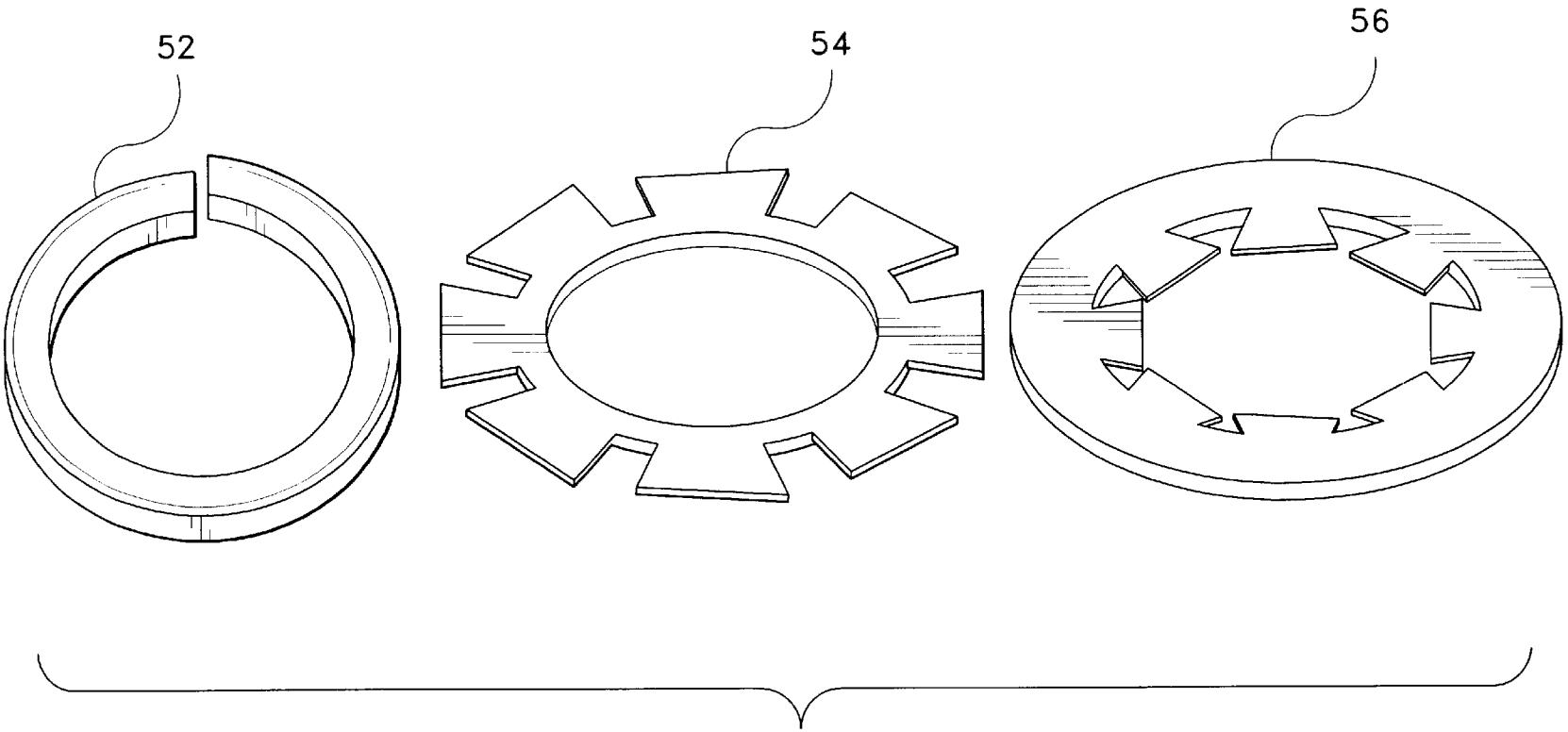
FIG. 4 is a perspective view showing various types of lock washer members that are usable in the female connector.

FIG. 4 shows exemplary lock washers, including a split ring lock washer 52 (or "helical spring washer"), an external tooth washer 54, and an internal tooth washer 56. However, any type of lock washer 50 is contemplated, including countersunk and combined internal/external washers. Also, any material for the washer 50 having a suitable resiliency is contemplated, including metal and plastic.

It is to be understood that the present invention is not limited to the embodiments described above, but encompasses any and all embodiments within the scope of the following claims.

I claim:

1. An internally locking coaxial cable connector for connecting a coaxial cable, comprising:

an outer body having a coupling nut slidable on the outer body, the coupling nut having an inwardly extending rear annular flange;

a conductive insert having a substantially cylindrical body having a front end and a rear end, the insert having an outwardly extending annular flange at the front end, the insert being retained in the outer body; and a lock washer disposed about the insert between the front flange of the insert and the rear flange of the coupling nut;

whereby when the coupling nut is threaded onto a male coaxial connector, the lock washer member is compressed between the front flange of the insert and the rear annular flange of the coupling nut so that the lock washer maintains a tension force between the female and male connectors to prevent separation of the connectors during use.

2. The internally locking coaxial cable connector according to claim 1, wherein the lock washer member is selected from the group consisting of a split ring washer, an external tooth washer, and an internal tooth washer.

3. The internally locking coaxial cable connector according to claim 1, wherein the coupling nut is hexagonally shaped.

4. The internally locking coaxial cable connector according to claim 1, wherein said insert is press fit into said outer body.

5. The internally locking coaxial cable connector according to claim 1, wherein said insert is crimped into said outer body.

* * * * *